US008113775B2

(12) United States Patent
Yoshida

(10) Patent No.: US 8,113,775 B2
(45) Date of Patent: Feb. 14, 2012

(54) AXIAL FLOW FAN

(75) Inventor: Yusuke Yoshida, Kyoto (JP)

(73) Assignee: Nidec Corporation, Kyoto (JP)

( * ) Notice: Subject to any disclaimer, the term of this patent is extended or adjusted under 35 U.S.C. 154(b) by 698 days.

(21) Appl. No.: 12/254,978

(22) Filed: Oct. 21, 2008

(65) Prior Publication Data

US 2009/0110551 A1 Apr. 30, 2009

(30) Foreign Application Priority Data

Oct. 31, 2007 (JP) ..... 2007-283002

(51) Int. Cl.
*F01D 1/00* (2006.01)
*F01D 1/04* (2006.01)

(52) U.S. Cl. ..... 415/220; 415/219.1; 415/224

(58) Field of Classification Search ..... 415/220, 415/219.1, 224
See application file for complete search history.

(56) References Cited

U.S. PATENT DOCUMENTS 7,094,028 B2 8/2006 Chang et al.
7,275,910 B2 * 10/2007 Chang et al. ..... 415/211.2
7,275,911 B2 * 10/2007 Lee et al. ..... 415/211.2
7,429,162 B2 9/2008 Lee et al.
7,824,154 B2 * 11/2010 Yabuuchi ..... 415/211.2
2005/0123399 A1 * 6/2005 Glatz et al. ..... 415/219.1
2006/0042894 A1 * 3/2006 Lee et al. ..... 188/267
2007/0286726 A1 * 12/2007 Yabuuchi ..... 415/220

FOREIGN PATENT DOCUMENTS

DE 103 32 814 A1 2/2005

* cited by examiner

*Primary Examiner* — Nitin Parekh
(74) *Attorney, Agent, or Firm* — Keating & Bennett, LLP

(57) ABSTRACT

The present invention provides an axial flow fan including an impeller that has a plurality of rotor vanes and is rotatable about a central axis, a motor that rotary drives the impeller, a base portion that supports the motor, a housing that has an intake vent, an exhaust vent, and an inner peripheral surface to surround the impeller and the motor, and a plurality of stator vanes that respectively connects the base portion and the housing, wherein the inner peripheral surface has a first inner peripheral surface formed to increase a distance from the central axis toward the intake vent or the exhaust vent in an axial direction, and there is formed a recess between the first inner peripheral surface and a stator vane that is included in the plurality of stator vanes and faces the first inner peripheral surface. According to the above described configuration, airflow is allowed to smoothly pass through the housing, resulting in a decrease in noise generated in the axial flow fan.

10 Claims, 6 Drawing Sheets

AXIAL FLOW FAN

BACKGROUND OF THE INVENTION

1. Field of the Invention

The present invention relates to an axial flow fan.

2. Description of the Related Art

FIG. 1 is a perspective view of a conventional axial flow fan 10. The axial flow fan 10 includes an outer frame 101, a plurality of stator vanes 102, and a base 103. The outer frame 101 is a hollow member provided with an intake vent and an exhaust vent. There is formed a diameter expanded part 101*a* and there are disposed the stator vanes 102 and the base 103 at the exhaust vent of the outer frame 101. The outer frame 101, the stator vanes 102, and the base 103 are integrally formed by injection molded resin.

In injection molding, one die is formed by combining two kinds of die parts, namely, a fixed die part and a movable die part. Melt resin is cast into the die and then is cooled. Thereafter, the cooled and solidified resin is taken out of the die. The outer frame 101, the stator vanes 102, and the base 103 are thereby formed as one member.

There are provided a plurality of seats 104 formed at parts where the diameter expanded part 101*a* and the stator vanes 102 are respectively joined. The seats 104 are positioned at blind portions when an integrally molded component having the outer frame 101, the stator vanes 102, and the base 103 is seen from a direction of being taken out of the die. When air is exhausted from the exhaust vent and hits the seats 104, there arise problems of noise generation, as well as decreases in volume of airflow and static pressure thereof.

SUMMARY OF THE INVENTION

The present invention provides an axial flow fan including an impeller that has a plurality of rotor vanes and is rotatable about a central axis, a motor that rotary drives the impeller, a base portion that supports the motor, a housing that has an intake vent, an exhaust vent, and an inner peripheral surface to surround the impeller and the motor, and a plurality of stator vanes that respectively connects the base portion and the housing, wherein the inner peripheral surface has a first inner peripheral surface formed to increase a distance from the central axis toward the intake vent or the exhaust vent in an axial direction, and there is formed a recess between the first inner peripheral surface and a stator vane that is included in the plurality of stator vanes and faces the first inner peripheral surface.

According to the above described configuration, airflow is allowed to smoothly pass through the housing, resulting in a decrease in noise generated in the axial flow fan. Moreover, decreases can be prevented in a volume of airflow taken into or exhausted from the axial flow fan as well as a static pressure thereof. Further, the housing can be molded with a smaller amount of resin, thereby realizing reduction in cost for manufacture of the axial flow fan.

Other features, elements, advantages and characteristics of the present invention will become more apparent from the following detailed description of preferred embodiments thereof with reference to the attached drawings.

DETAILED DESCRIPTION OF PREFERRED EMBODIMENT

Figure 1:
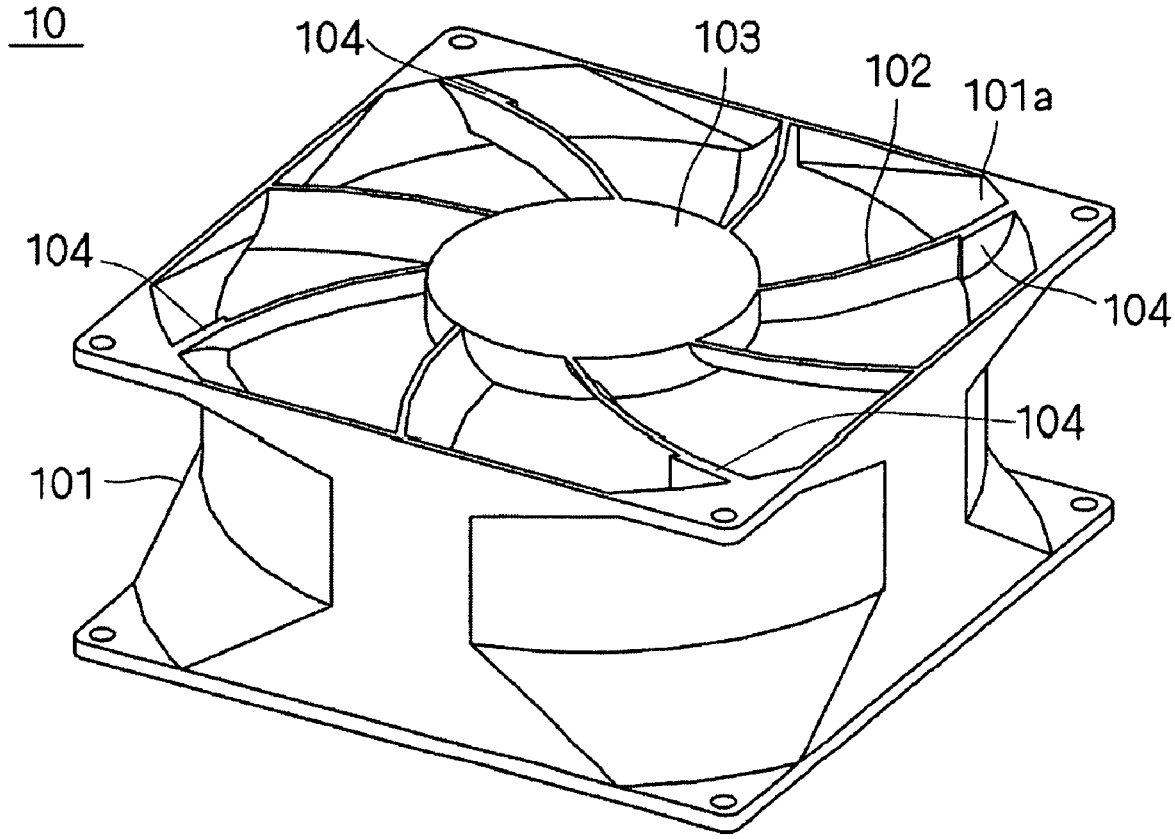
Fig.1 (Prior Art)
FIG. 1 is a perspective view of a conventional axial flow fan.

Referring to FIGS. 2 through 6, preferred embodiments of the present invention will be described in detail. It should be noted that in the explanation of the present invention, when positional relationships among and orientations of the different components are described as being up/down or left/right, ultimately positional relationships and orientations that are in the drawings are indicated; positional relationships among and orientations of the components once having been assembled into an actual device are not indicated. Meanwhile, in the following description, an axial direction indicates a direction parallel to a rotation axis, and a radial direction indicates a direction perpendicular to the rotation axis.

Figure 2:
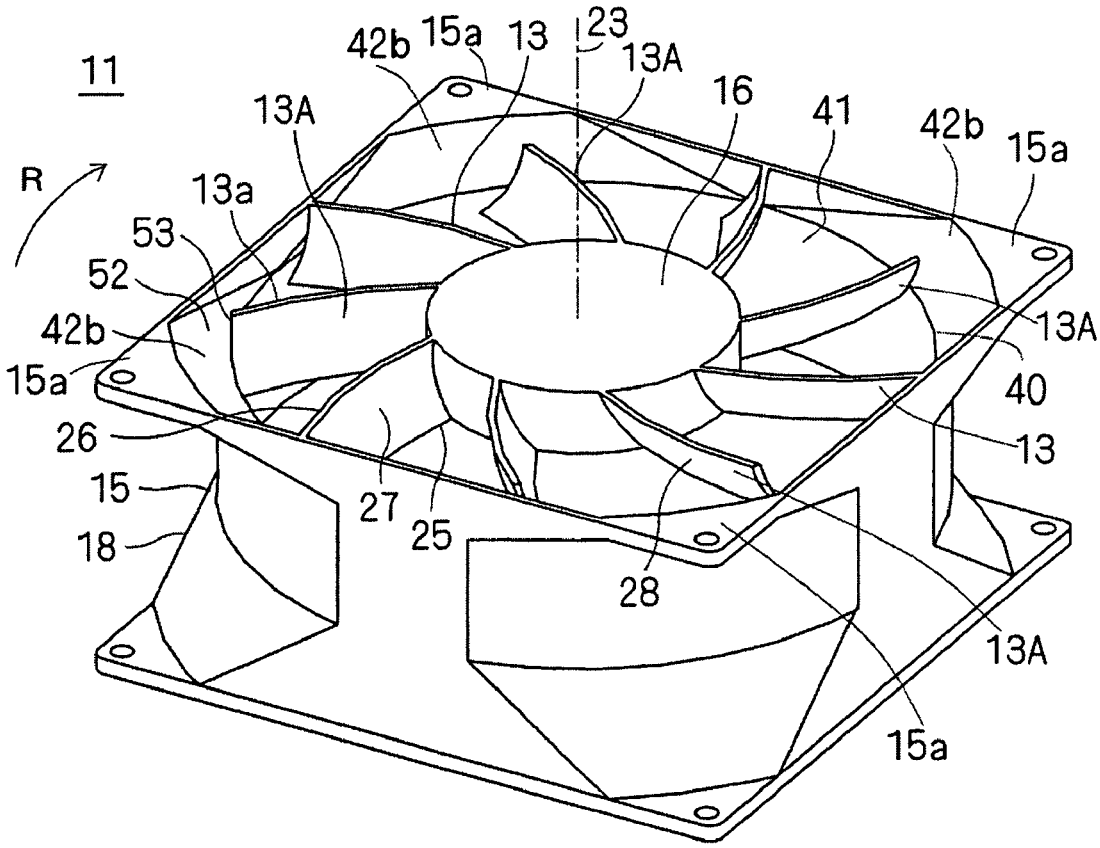
FIG. 2 is a perspective view of an axial flow fan according to a first preferred embodiment of the present invention.
Figure 3:
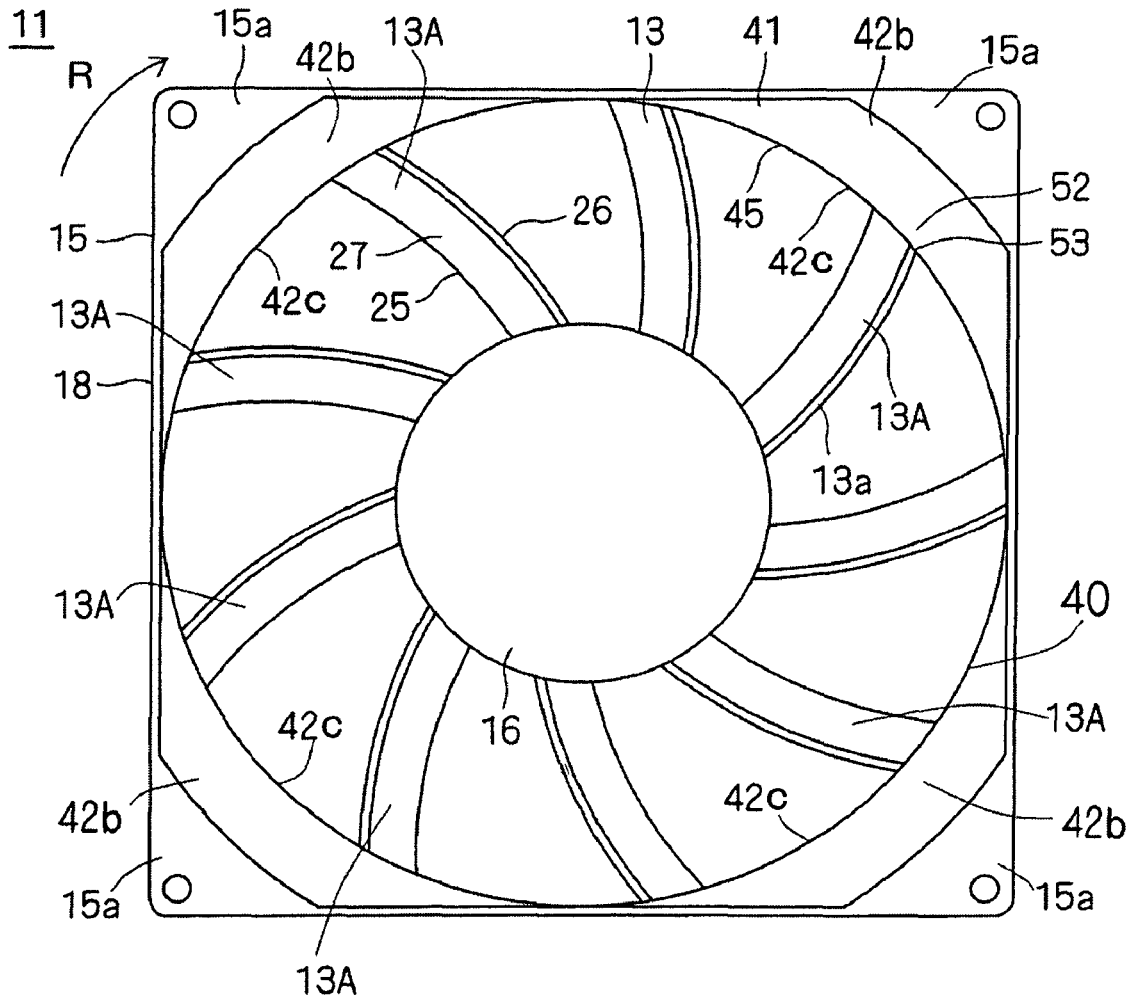
FIG. 3 is a plan view of the axial flow fan shown in FIG. 2, which is seen from an exhaust side thereof.
Figure 4:
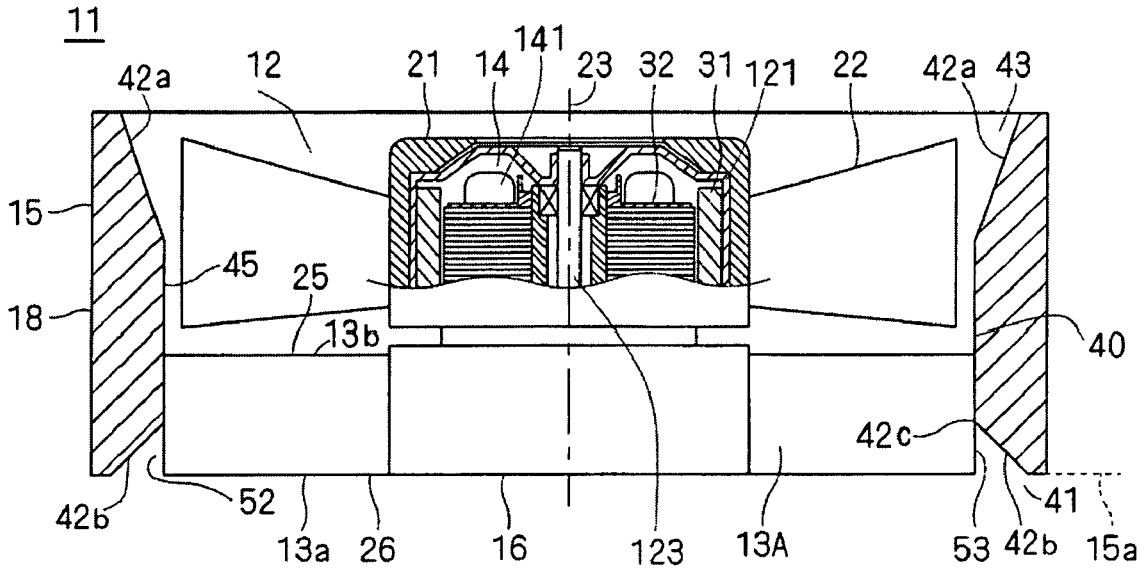
FIG. 4 is a cross sectional view of the axial flow fan shown in FIG. 2.

FIGS. 2, 3, and 4 are respectively a perspective view, a plan view, and a cross sectional view of an axial flow fan 11 according to a first preferred embodiment of the present invention.

As shown in FIGS. 2, 3, and 4, the axial flow fan 11 preferably includes an impeller 12, a plurality of stator vanes 13, a motor portion 14, and a housing 18. The impeller 12 is preferably rotary driven about a central axis 23 by the motor portion 14. The housing 18 is preferably a hollow member provided with an exhaust vent 41 and an intake vent 43. The stator vanes 13 are preferably disposed at the exhaust vent 41, and are formed integrally with the housing 18 by injection molded resin. Alternatively, the stator vanes 13 and the housing 18 may be integrally formed by aluminum die-casting.

As shown in FIG. 4, the impeller 12 preferably includes a cup 21 in a capped and substantially cylindrical shape, and a plurality of rotor vanes 22. The rotor vanes 22 are preferably disposed on an outer peripheral surface of a cylindrical wall of the cup 21 so as to be equally spaced apart from each other in a circumferential direction around the central axis 23. There is preferably fixed a rotor holder 121 to an inner side of the cup 21. The rotor holder 121 is preferably a capped and substantially cylindrical member made of a magnetic material (such as a metal material). The rotor holder 121 preferably includes a cylindrical inner peripheral surface to which a rotor magnet 31 in a substantially annular shape is fixed. There is fixed by press fitting or the like to a capped part of the rotor holder 121 a shaft 123 having a substantially columnar shape.

As shown in FIG. 4, the motor portion 14 is preferably disposed in the impeller 12 and includes a stator 141 (partially shown) and a circuit board (not shown). The stator 141 radially preferably faces the rotor magnet 31 and is electrically connected to the circuit board. The circuit board and the stator 141 preferably receive electric currents and control signals transmitted from an external power supply (not shown) through a plurality of lead wires (not shown). When the stator 141 is supplied with an electric current, there is generated a magnetic field at the stator 141. Interaction between the magnetic field generated at the stator 141 and a magnetic field of the rotor magnet 31 causes torque between the stator 141 and the rotor magnet 31. Such torque preferably rotary drives the impeller 12 about the central axis 23 to cause airflow along the central axis 23. It should be noted that, in FIG. 4, air flows from the axially upper side to the axially lower side (namely, from the intake vent 43 to the exhaust vent 41).

As shown in FIGS. 2, 3, and 4, the housing 18 has an outer frame 15 and a base portion 16. The outer frame 15 is preferably a hollow member in a substantially square pole shape. In planar view, the outer frame 15 preferably includes a substantially rectangular outline and an inner peripheral surface 40 in a substantially circular shape.

The inner peripheral surface 40 preferably includes intake-side first inner peripheral surfaces 42*a* respectively formed at four corners thereof of the intake vent 43. The intake-side first inner peripheral surfaces 42*a* preferably are formed so as to gradually increase the radial distance between the central axis 23 and the inner peripheral surface 40 toward the intake vent 43 in the axial direction. Similarly, the inner peripheral surface 40 preferably includes exhaust-side first inner peripheral surfaces 42*b* respectively formed at four corners thereof of the exhaust vent 41 so as to gradually increase the radial distance between the central axis 23 and the inner peripheral surface 40 toward the exhaust vent 41 in the axial direction.

As shown in FIG. 4, the inner peripheral surface 40 preferably includes a second inner peripheral surface 45 formed to be substantially in parallel with the central axis 23. The second inner peripheral surface 45 and the respective first inner peripheral surfaces 42 preferably are smoothly continued to each other.

The base portion 16 is preferably a bottomed and substantially cylindrical member and axially supports the motor portion 14. The base portion 16 is preferably disposed in the outer frame 15 at the intake vent 43 in the axial direction. The base portion 16 preferably includes a surface, on the axially exhaust side, which is flush with respect to ends 15*a* of the outer frame 15 on the axially exhaust side.

As shown in FIGS. 2, 3, and 4, the stator vanes 13 are preferably disposed between the inner peripheral surface 40 of the outer frame 15 and the outer peripheral surface of the base portion 16 so as to be equally spaced apart from each other in the circumferential direction, thereby serving as connectors between the inner peripheral surface 40 and the base portion 16. Each of the stator vanes 13 preferably includes a first edge 25, a second edge 26, a first surface 27, and a second surface 28. The first surface 27 and the second surface 28 are preferably inclined with respect to the central axis 23, and the first edge 25 is positioned on the intake side in the axial direction while the second edge 26 is positioned on the exhaust side thereof. The first edge 25 is preferably formed to be positioned on the opposite side with respect to the second edge 26 in a direction R of rotation of the impeller 12. The first surface 27 is preferably oriented opposite to the direction R of rotation of the impeller 12 so as to mainly receive airflow which is generated by rotation of the impeller 12. It should be noted that the impeller 12 is rotated in the direction R of rotation clockwise about the central axis 23, as shown in FIG. 2. Further, each of the stator vanes 13 preferably includes an axial cross section in a vane shape with curved surfaces. According to such a configuration, an air circulative component generated by rotation of the impeller 12 is transformed to a component flowing along the central axis 23, resulting in an increase in static pressure of air.

Alternatively, the first and second surfaces 27 and 28 may be made inclined with respect to the central axis 23 at a different angle, so that airflow is oriented to an arbitrary direction (such as the radially outward direction). The stator vanes 13 may be disposed not at the exhaust vent 41 but at the intake vent 43 in the axial direction. In this case, the second edge 26 is positioned on the opposite side with respect to the first edge 25 in the direction R of rotation of the impeller 12. Air is oriented by the stator vanes 13 and is taken into the housing 18. Accordingly, reduced is noise generated by airflow hitting the inner peripheral surface 40 and the like.

As shown in FIGS. 2, 3, and 4, the plurality of stator vanes 13 preferably include a plurality of stator vanes 13A each of which extends from the central axis 23 toward the corresponding exhaust-side first inner peripheral surface 42*b*. There is formed a recess 52 at a part where a first outer edge 53 of each of the stator vanes 13A is connected to the corresponding exhaust-side first inner peripheral surface 42*b*. The recess 52 is preferably a space surrounded by the first outer edge 53 and the corresponding exhaust-side first inner peripheral surface 42*b*. In other words, an end of the first outer edge 53 on the axially exhaust side radially faces the corresponding exhaust-side first inner peripheral surface 42*b* with the recess 52 interposed therebetween. On the other hand, an end of the first outer edge 53 on the axially intake side is connected to the second inner peripheral surface 45.

Such a configuration minimizes a volume of each of the seats which is formed at a connection between the first outer edge 53 and the corresponding exhaust-side first inner peripheral surface 42*b*. Therefore, airflow generated by rotation of the impeller 12 is allowed to smoothly pass in the vicinity of the respective connections. As a result, reduced is noise generated by airflow hitting the connections.

In addition, as the volume of each of the seats is minimized, there is secured a space to arrange therein the impeller 12 within the housing 18, thereby realizing increases in volume of airflow and static pressure thereof.

The volume of each of the seats, which is minimized, enables reduction in the amount of resin required for forming of the housing 18 (the amount of aluminum, aluminum alloy, or the like in the case of aluminum die-casting). Therefore, reduction is realized in the cost of the material for the axial flow fan 11.

The end of the first outer edge 53 on the axially intake side is preferably connected to a part 42*c* having a minimized diameter on the exhaust-side first inner peripheral surface 42*b* (more specifically, the end of the second inner peripheral surface 45 on the axially exhaust side). Accordingly, secured are strength of the connection between each of the stator vanes 13A and the inner peripheral surface 40 as well as an inner diameter of the second inner peripheral surface 45. It should be noted that each of the stator vanes 13A may be connected to both the corresponding exhaust-side first inner peripheral surface 42*b* and the second inner peripheral surface 45 including the boundary therebetween. Further, the second edges 26 of the stator vanes 13 are formed to be flush with respect to the ends 15*a* of the outer frame 15, thereby realizing prevention of an increase in size of the outer frame 15.

Figure 5:
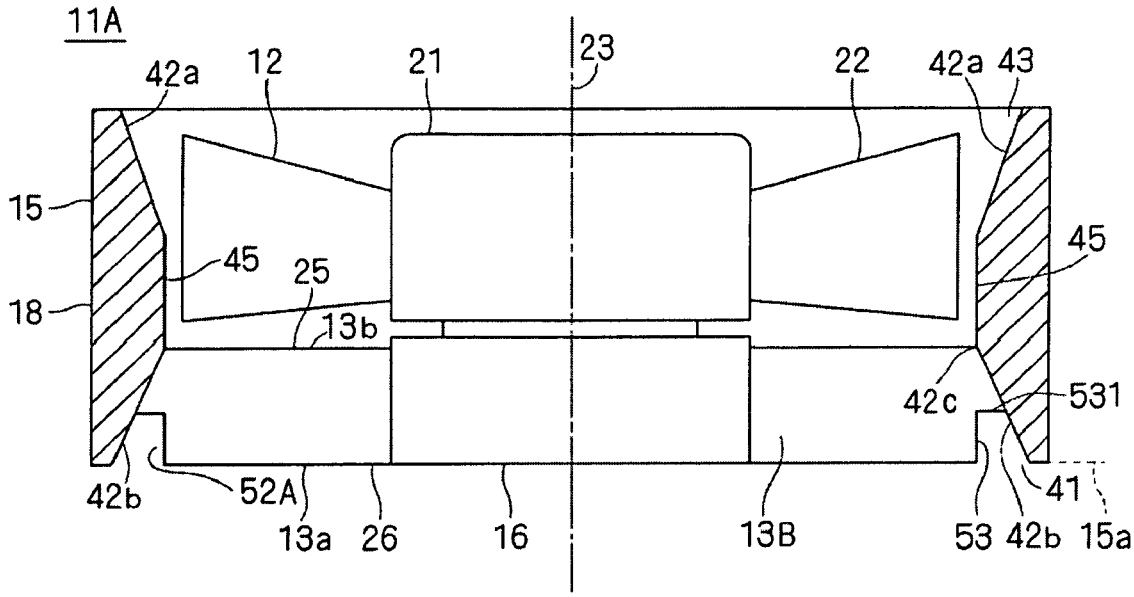
FIG. 5 is a cross sectional view of an axial flow fan according to a first preferred modification of the present invention.

Described below is an axial flow fan 11A according to a first preferred modification made to the first preferred embodiment of the present invention. FIG. 5 is a cross sectional view of the axial flow fan 11A. The element of the axial flow fan 11A identical to that of the axial flow fan 11 is denoted by the similar reference symbol, and description thereof will omitted.

As shown in FIG. 5, the axial flow fan 11A preferably includes a plurality of stator vanes 13B which are connected to the respective first inner peripheral surfaces 42. Similarly to the stator vanes 13A, the stator vanes 13B are preferably disposed between the base portion 16 and the inner peripheral surface 40 so as to be equally spaced apart from each other in the circumferential direction.

There is formed a recess 52A on the axially exhaust side of a radially outer end of each of the stator vanes 13B. The recess 52A is preferably a space surrounded by a first outer edge 53 which is substantially in parallel with the central axis 23, a second outer edge 531 which is substantially perpendicular to the first outer edge 53, and an exhaust-side first inner peripheral surface 42*b*. On the other hand, the radially outer end of each of the stator vanes 13B is preferably connected on the axially intake side thereof to the corresponding exhaust-side first inner peripheral surface 42*b*. Both the recess 52A and the end of the stator vane 13B on the axially intake side are preferably overlapped with the corresponding first inner peripheral surface 42 when the recess 52A is seen in the axial direction. According to such a configuration, the volume of the seat formed at the connection between the stator vane 13B and the inner peripheral surface 40 is minimized. As a result, reduced is noise generated by airflow hitting the respective connections, and prevented are decreases in volume of airflow and static pressure thereof.

Each of the stator vanes 13B preferably includes an end 13*a*, on the axially exhaust side, which is flush with respect to the ends 15*a* of the outer frame 15. According to such a configuration, the axial dimension of the axial flow fan 11A is suppressed to realize reduction in size of the axial flow fan 11A.

Each of the stator vanes 13B preferably includes an end 13*b*, on the axially intake side, which is flush with respect to parts (the boundaries between the second inner peripheral surface 45 and the respective exhaust-side first inner peripheral surfaces 42*b*) having a minimized diameter on the exhaust-side first inner peripheral surfaces 42*b*. According to such a configuration, there is secured an adequate space for disposing the impeller 12 in the housing 18. Airflow generated by rotation of the impeller 12 is guided smoothly to the stator vanes 13, and reduced is noise generated by airflow hitting the stator vanes 13B. It should be noted that the radially outer end of each of the stator vanes 13B may be connected to both the second inner peripheral surface 45 and the corresponding first inner peripheral surface 42 including the boundary therebetween.

The first outer edge 53 and the second outer edge 531 may not necessarily form an angle equal to 90 degrees, but may form an acute angle or an obtuse angle. Further alternatively, the respective stator vanes 13B may have such angles different from one another.

Figure 6:
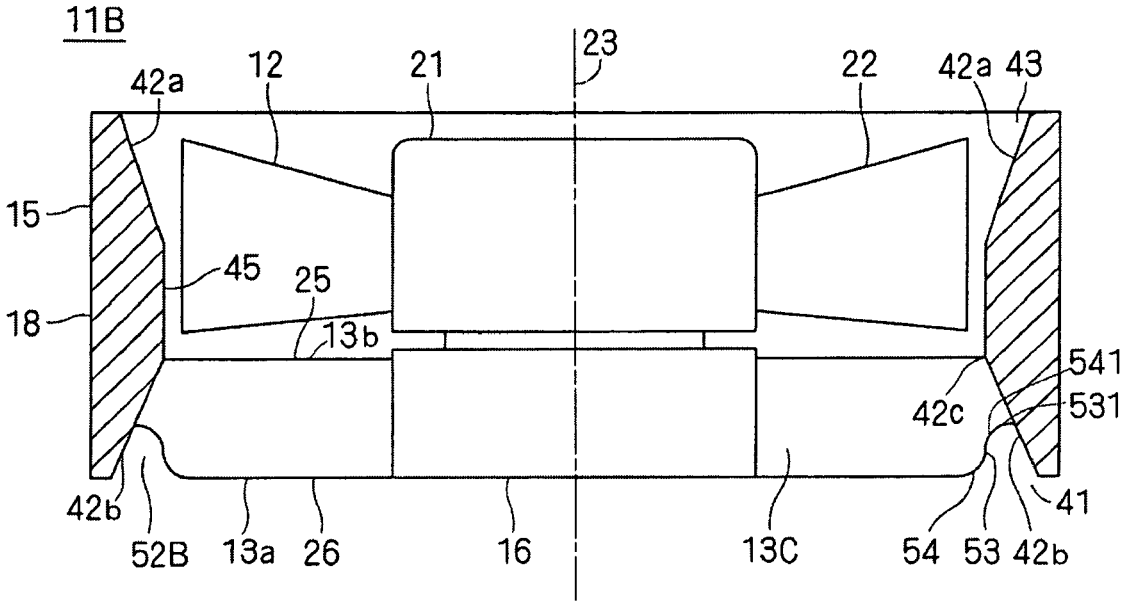
FIG. 6 is a cross sectional view of an axial flow fan according to a second preferred modification of the present invention.

FIG. 6 is a cross sectional view of an axial flow fan 11B according to a second preferred modification made to the first preferred embodiment of the present invention. The constituent of the axial flow fan 11B identical to that of the axial flow fan 11 or 11A is denoted by the identical reference symbol, and description thereof will be omitted.

As shown in FIG. 6, the axial flow fan 11B preferably includes a plurality of stator vanes 13C which are connected to the respective exhaust-side first inner peripheral surfaces 42*b*. A radially outer end of each of the stator vanes 13C is preferably connected on the axially intake side thereof to the corresponding exhaust-side first inner peripheral surface 42*b*. On the other hand, there is formed a recess 52B at the radially outer end of the stator vane 13C on the axially exhaust side. The recess 52B and the end of the stator vane 13C on the axially intake side are preferably overlapped with the corresponding exhaust-side first inner peripheral surface 42*b* when the recess 52B is seen in the axial direction.

As illustrated in FIG. 6, a boundary 54 between the first outer edge 53 and the end 13*a* on the axially exhaust side is preferably chamfered. Similarly, a boundary 541 between the first outer edge 53 and the second outer edge 531 is chamfered. Such a configuration reduces as much as possible the volume of the seat formed at a boundary between the stator vane 13C and the corresponding exhaust-side first inner peripheral surface 42*b*. As a result, airflow is allowed to smoothly pass in the vicinity of the boundary 54 and the boundary 541 of each of the stator vanes 13C. Alternatively, the boundary 54 or 541 may be formed as a surface in a C-letter shape.

The first outer edge 53 may be positioned radially inside or outside the second inner peripheral surface 45. The boundary 54 or 541 may be chamfered into a shape different from one another in the respective recesses 52B or the respective stator vanes 13C.

Alternatively, the stator vanes 13A, 13B, and 13C according to the present invention may be provided on the axially intake side (that is, at the intake vent 43). The axial flow fan may include more than one type of stator vanes selected from the stator vanes 13A, 13B, and 13C according to the present invention. Further, the radially outer end of each of the stator vanes 13A, 13B, and 13C may be connected to a part other than the exhaust-side first inner peripheral surface 42*b*. Even in such cases, airflow is allowed to smoothly pass in the vicinity of the respective stator vanes.

The intake-side first inner peripheral surfaces 42*a* may have a shape different from that of the exhaust-side first inner peripheral surfaces 42*b*. Further, the respective intake-side first inner peripheral surfaces 42*a* (or the respective exhaust-side first inner peripheral surfaces 42*b*) may have shapes different from one another at the respective corners, and may have distances from the central axis 23 different from one another.

While the preferred embodiment and the preferred modifications of the present invention have been described above, the present invention is not limited to the above cases. It is to be understood that variations and modifications will be apparent to those skilled in the art without departing the scope and spirit of the present invention. The scope of the present invention, therefore, is to be determined solely by the following claims.

What is claimed is:

1. An axial flow fan comprising:

an impeller arranged to include a plurality of rotor vanes and to be rotatable about a central axis;

a motor portion arranged to rotatingly drive the impeller;

a base portion arranged to support the motor;

a housing including an intake vent, an exhaust vent, and an inner peripheral surface surrounding the impeller and the motor portion; and a plurality of stator vanes arranged to respectively connect the base portion and the housing; wherein the inner peripheral surface includes a first inner peripheral surface provided such that a distance between the central axis and the first inner peripheral surface increases toward the intake vent and the exhaust vent in an axial direction;

among the plurality of stator vanes, a first stator vane is arranged to respectively connect the base portion and the first inner peripheral surface, the first stator vane including a first outer edge, a second outer edge, and a third outer edge;

the first outer edge is arranged to face the first inner peripheral surface with a recess interposed therebetween;

the second outer edge and the third outer edge, both of which are perpendicular or substantially perpendicular to the central axis, are connected with the first outer edge; and a connecting point of the first outer edge and the second outer edge is arranged radially outside an outermost edge of the impeller.

2. The axial flow fan according to claim 1, wherein at least a portion of the first stator vane is joined to the first inner peripheral surface.

3. The axial flow fan according to claim 1, wherein the inner peripheral surface of the housing includes a second inner peripheral surface formed substantially parallel with the central axis, and at least a portion of the first stator vane is joined to the second inner peripheral surface.

4. The axial flow fan according to claim 3, wherein the distance between the inner peripheral surface and the central axis is shortest at a portion thereof between the second inner peripheral surface and the central axis.

5. The axial flow fan according to claim 1, wherein the first outer edge is arranged radially inside the first inner peripheral surface or the second inner peripheral surface.

6. The axial flow fan according to claim 1, wherein the housing, the base portion, and the plurality of stator vanes are formed as a single continuous member.

7. The axial flow fan according to claim 1, wherein the plurality of stator vanes includes an axial end flush with an axial end of the housing.

8. The axial flow fan according to claim 1, wherein the first outer edge and the second outer edge are continuous with each other, and the first outer edge and the second outer edge define a chamfered boundary therebetween.

9. The axial flow fan according to claim 1, wherein the first outer edge and the third outer edge define a chamfered boundary.

10. The axial flow fan according to claim 1, wherein the plurality of stator vanes is disposed at the exhaust vent.

* * * * *